US006393610B1

(12) United States Patent
Parks

(10) Patent No.: US 6,393,610 B1
(45) Date of Patent: May 28, 2002

(54) ARTICULATED KNEE AND SHIN GUARD

(75) Inventor: Gerald R. Parks, San Diego, CA (US)

(73) Assignee: JT USA, Inc., Chula Vista, CA (US)

( * ) Notice: Subject to any disclaimer, the term of this patent is extended or adjusted under 35 U.S.C. 154(b) by 0 days.

(21) Appl. No.: 09/799,894

(22) Filed: Mar. 7, 2001

(51) Int. Cl.[7] ..... A41D 13/06

(52) U.S. Cl. ..... 2/22; 2/911; 128/882; 602/62

(58) Field of Search ..... 2/22, 24, 16, 62, 2/455, 911; 128/881, 882; 602/16, 23, 26, 62

(56) References Cited

U.S. PATENT DOCUMENTS 5,455,969 A 10/1995 Pratson
5,477,559 A * 12/1995 Clement ..... 2/22
5,652,956 A * 8/1997 Hoshizaki et al. ..... 2/22
5,732,411 A * 3/1998 Coleman et al. ..... 2/22
5,915,529 A * 6/1999 Popowski ..... 2/16
5,954,678 A * 9/1999 Cruz ..... 602/26
6,205,583 B1 * 3/2001 Beland ..... 2/16

* cited by examiner

*Primary Examiner*—John J. Calvert
*Assistant Examiner*—Tejash Patel
(74) *Attorney, Agent, or Firm*—Henri J. A. Charmasson; John D. Buchaca

(57) ABSTRACT

An articulated device for protecting the knee as well as above-the-knee and below-the-knee leg portions comprises a first part shaped and dimensioned to cup the knee and cradle a small section of the leg above it. A second part forming a greave for the below-the-knee portion of the leg is slidingly connected to a longitudinal plate which is hinged at its top to the lower edge of the first part. An adjustable elastomeric strap biases the second part away from the first part, allowing the two parts to move axially in relation to one another during flexion and extension of the knee, while keeping the device tautly against the leg and knee at all times.

12 Claims, 2 Drawing Sheets

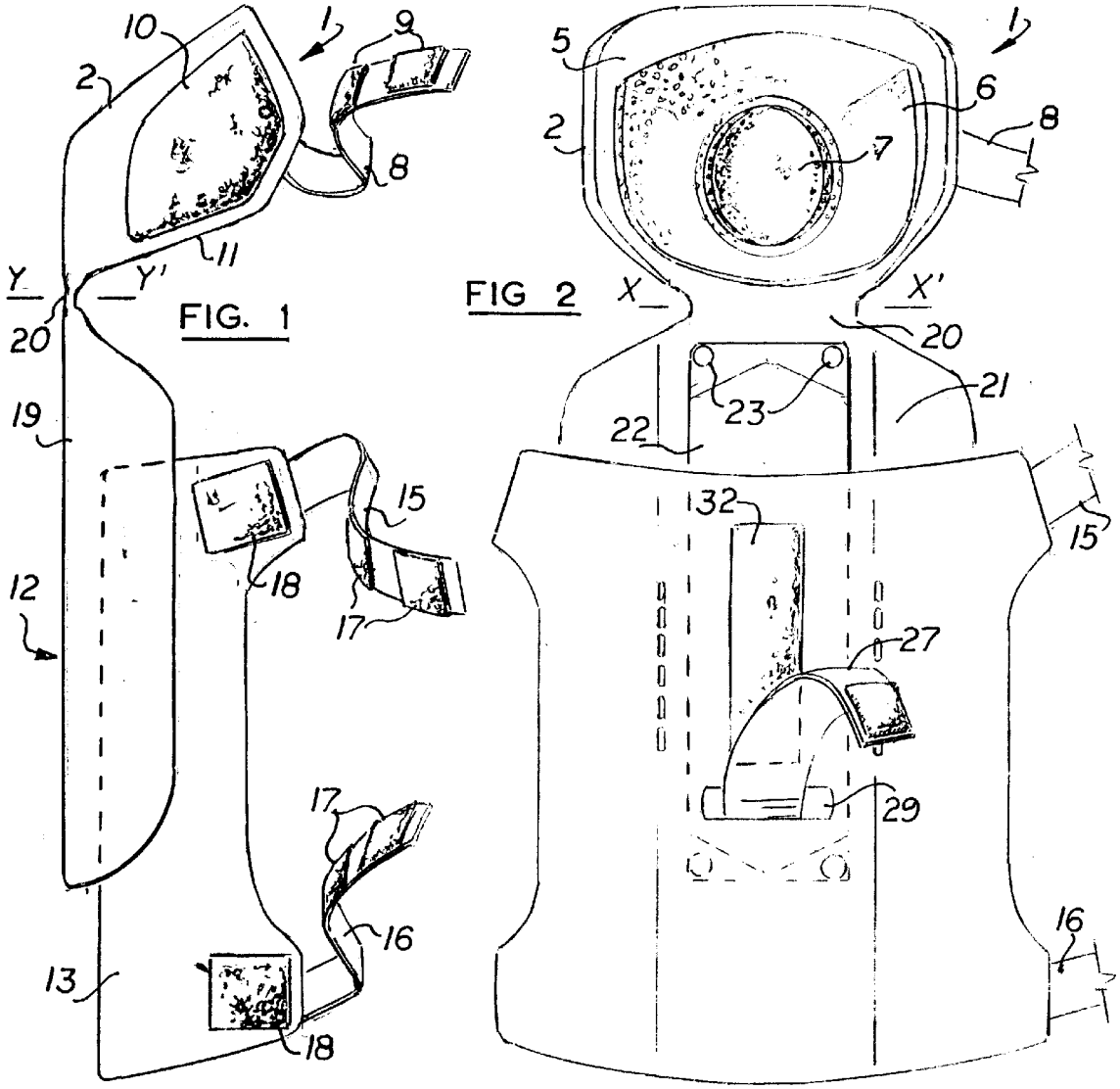
FIG. 1
FIG 2
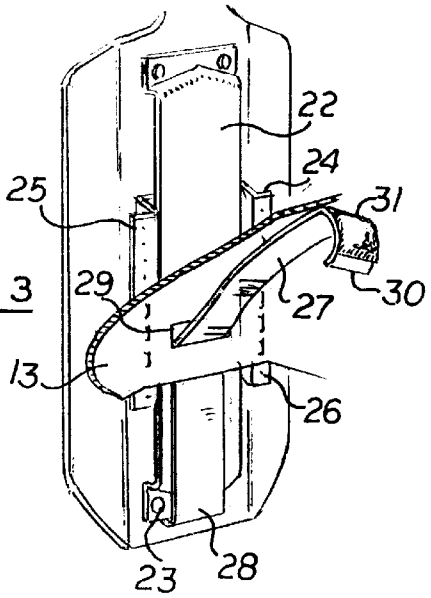
FIG. 3
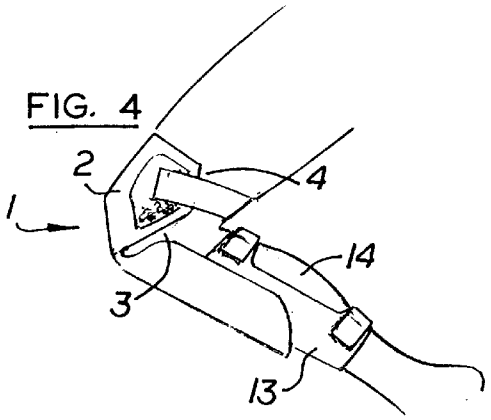
FIG. 4

ARTICULATED KNEE AND SHIN GUARD

FIELD OF THE INVENTION

This invention relates to protective covers for limbs and their articulations, and more particularly to knee and shin guards used in the practice of various types of sporting activities such as hockey, baseball, motor cross, and war games.

BACKGROUND OF THE INVENTION

Many sport practitioners must shield parts of their bodies against harmful impacts. In particular, baseball catchers, hockey goalies, motor cross enthusiasts commonly wear protective padding over their shins, knees, and upper legs. Many other activities, both recreational and work related entail placing certain joints of the body into contact with hard surfaces which over time tend to create discomfort and even injury. Carpet and tile layers, roofers, and some agricultural workers to name a few, benefit from knee protection. The protection of an elbow or knee calls for devices that, by necessity, must attach above and below the articulation. Because elbows and knees are complex articulation that have oddly shaped and shifting profiles, it becomes extremely difficult to provide an articulated covering of the articulation that closely espouses the contour of the articulation without applying undue and uncomfortable strain upon the device attachments. In a knee or elbow, the axis of articulation is not only distant from the outer concave surface, but, due to the complexity of the articulation, that axis is subject to a slight translation as well as rotation. As disclosed in U.S. Pat. No. 5,455,969 Pratson et al. Prior attempts to deal with these complex conditions in a hingeed knee protector consisted in placing the axis of rotation between the upper and lower parts of the device away from the skin surface and almost in line with the knee approximate rotational axis. Moreover, the outer surf ace expansion of the knee during flexion was accommodated by providing a broad overlap of one part over the other. However, the rigidity of the device did not provide for any lateral flexion or for the slight translation of the actual articulation axis of the knee. The device was subject to shifting, popping out, and applying uncomfortable pulling force upon the securing straps.

The present invention results from an attempt to accommodate the complex movement of a knee or elbow articulation in the construction of an effective padding and shielding structure for upper or lower limbs.

SUMMARY OF THE INVENTION

The principal and secondary objects of this invention are to provide an ergonomic shielding and padding structure for human limbs and their articulations which conforms intimately with the geometrically complex flexion and extension of knees, elbows, shoulders and other joints, to provide stable and comfortable attachment of the shielding and padding structure to a section of the limbs, and provide multi-axial movement of one part of the structure in relation to the other.

These and other valuable objects are achieved by means of a protective structure comprises two parts, each shaped and dimensioned to intimately cradle a portion of two members joined by a complex articulation. The two parts are joined by an articulated plate which is hingedly and loosely connected at one end to one of the parts, and is slidingly connected to the other part by a resiliently and axially expandable attachment.

BRIEF DESCRIPTION OF THE DRAWING

FIG. 1 is a side elevational view of an articulated knee and leg protective device according to the invention;

FIG. 2 is a back elevational view thereof;

FIG. 3 is a detail perspective view of the connecting plate attachment mechanism;

FIG. 4 is a side view of the device in use;

DESCRIPTION OF THE PREFERRED EMBODIMENT OF THE INVENTION

Figure 6:
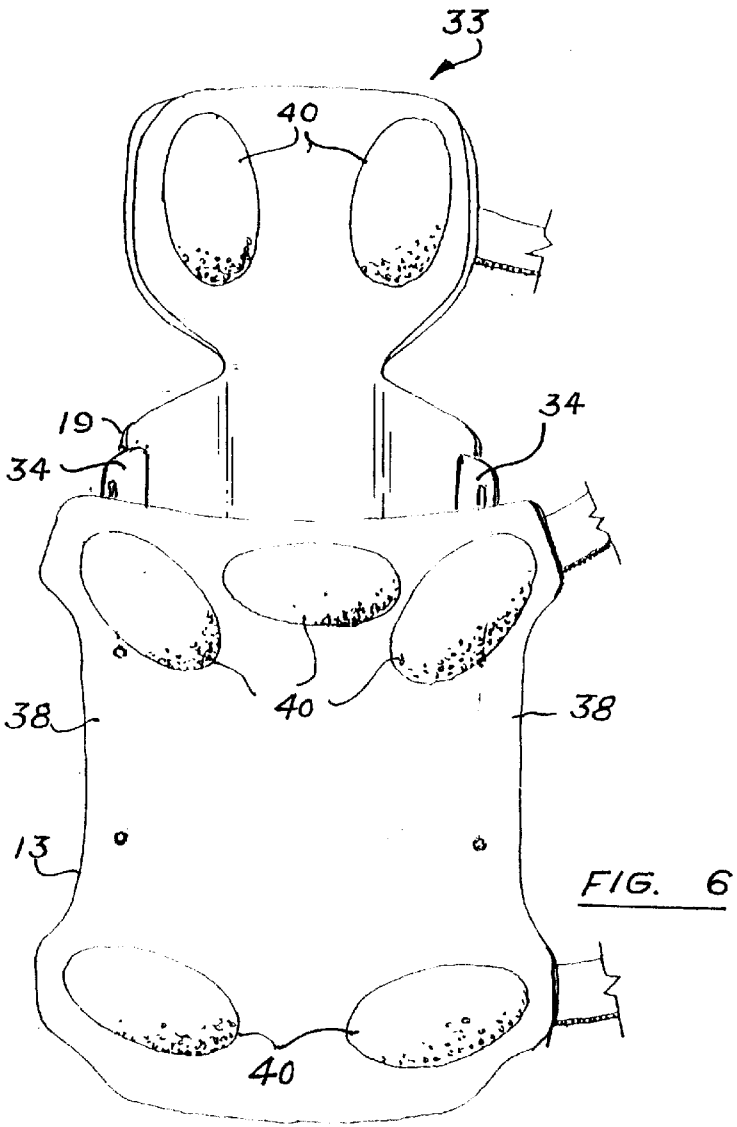
FIG. 6 is a back elevational view thereof.

Referring now to the drawing, there is shown an embodiment of the invention 1 specifically designed to provide protection for the skin, knee, and a portion of the upper leg of its user. It should be understood that other embodiments of the invention structurally similar to the below-described embodiment can be implemented to provide protection to other parts of an animal body including the elbow, shoulder, ankles, and neck.

The protective device comprises a first part 2 shaped and dimensioned to cover, and comfortably and intimately cradle the knee 3 of a user, as well as a small section 4 of the upper leg immediately above the knee. The first part includes an outer shell 5 and a pad 6 of resilient synthetic foam material lining the inside surface of the first part. An oval padded cavity 7 in the middle of the resilient lining 6 is shaped to nest the patella. A slightly resiliently stretchable strap 8 is permanently connected at one end to one side of the first part. The opposite end is provided with a series of fabric fastener patches 9 for interconnection with a cooperating larger patch 10 of fabric fastener bonded to the opposite side of the first part. Accordingly, the tension of the strap 8 can be adjusted by selection of one of the fastener patches 9 to be applied to the larger patch 10. It should be noted that the lower edge 11 of a fraction of the sides of part 1 are obliquely oriented in order to provide clearance during flexion.

The second part 12 of the protective device comprises a greave or shin guard 13 which is shaped and dimensioned to intimately and comfortably cradle the anterior part of the lower or below-the-knee limb 14. A pair of straps 15, 16 substantially similar to the one described in connection with the first part, and each similarly provided with a series of fabric fastener patches 17, are dimensioned to secure the greave 13 around the limb by adjustable attachment to the corresponding patches 18 that are bonded to the opposite side of the greave. The second part 12 further comprises a connecting plate 19 which is attached at its upper end to the first part 2 by means of a width of padding material forming a flexible hinge 20. The hinge is constituted by a section of protective padding having a narrowed thickness. This feature allows, not only for a wide angle rotation about a transversal axis X', but also a slight degree of rotation about a front-to-back axus Y–Y'.

The connecting plate 19 is shaped and dimensioned to wrap around the anterior part of the shin guard 13 to form a trough 21 into which the shin plate can axially slide up and down. The lower half of the connecting plate 19 is slidingly attached to the shin guard 13 by a mechanism more specifically illustrated in FIG. 3.

A narrow plate or rail 22 is mounted longitudinally against the bottom of the trough 21, that this, against the inner surface of the connecting plate, by sets of rivets 23, and the major portion of the rail stands slightly apart from the bottom of the trough 21. The rail is preferably made of a semi-rigid strip of plastic. A loop 24 of tough fabric is stitched along its opposite edges 25, 26 to the anterior surface of the shin guard 13, engaging the rail 22. Since the length of the loop 24 is less than half the length of the rail 22, the shin guard 13 can slide longitudinally within the trough 21. A band 27 of elastomeric material has its lower extremity 28 secured to the inner lining of the connecting plate 19 at the base of the rail 22. The band passes through a slit or window 29 cut into a median portion of the shin guard 13, and its free end 30 is provided with a patch of fabric fastener 31 that can be connected at a variety of locations along an elongated cooperating patch 32 of fabric material that is bonded to the back face of the shin guard. Due to the longitudinal orientation of the second patch of fabric fastener 32, the tension applied by the band 27 to the shin guard 13 in a biasing force downwardly and away from the first part can be adjusted. Accordingly, the resiliently sliding attachment of the shin guard to the connecting plate 19 favorizes the stability of the whole protective structure and its constant conformity to the anterior surface of the articulated members and limits the amount of strain applied to the retaining straps 8, 15 and 16.

Figure 5:
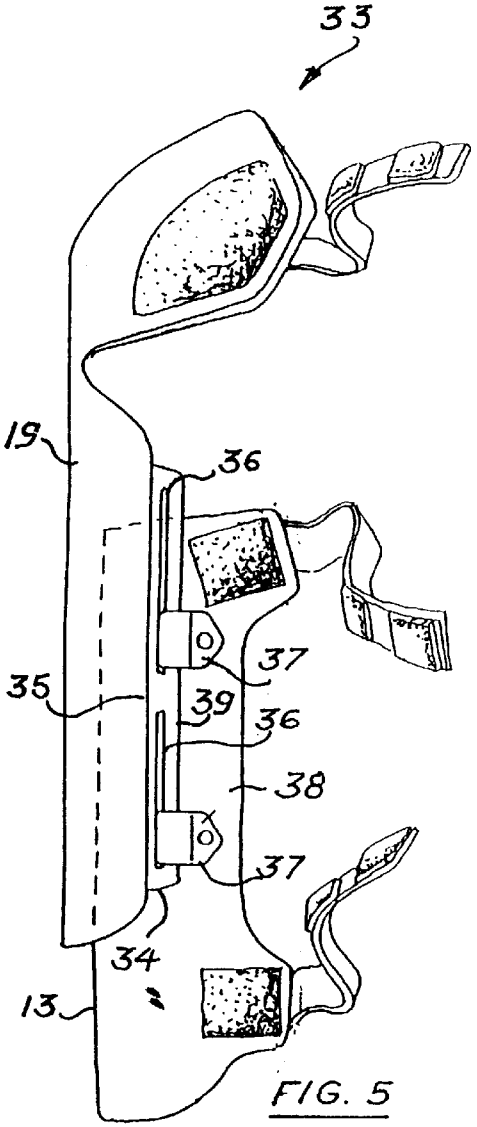
FIG. 5 is a side elevational view of an alternate embodiment.

In an alternate embodiment 33 of the invention illustrated in FIGS. 5 and 6, the plate 19 is slidingly connected to the shin guard 13 by a structure comprising a pair of wings 34 secured along the lateral edges 35 of the plate. Longitudinal slots 36 along each wing are engaged by loop member 37 riveted to the lateral edges 38 of the shin guard. Each loop member must have a width substantially shorter than the guiding member formed by each slot and the outer edge 39 of the wing which it engages.

There is no resilient biasing between the plate and the shin guard. Traction pads 40 of thick foam are bonded to the inside surface of the first knee-covering part 2, and the shin guard 13.

The sheet material used in the fabrication of the devices is preferably selected from heat-formable synthetic composition including high-density foam lined with a strong cloth.

While the preferred embodiments of the invention have been described, modifications can be made and other embodiments may be devised without departing from the spirit of the invention and the scope of the appended claims.

What is claimed is:

1. A device for protecting first and second elongated members and their articulated joint which comprises:

a first part shaped and dimensioned to intimately cradle a portion of said first member;

a second part shaped and dimensioned to intimately cradle a portion of the said second member;

an oblong plate having an inner face, an outer face, first and second opposite longitudinal end sections, and first and second opposite lateral edges;

means for hingedly connecting said first end section to said first part about a transversal axis; and, means for axially and slidingly connecting said inner face to said second part;

wherein said plate further comprises:

at least one elongated guide member having a given length, an upper end secured to said first end section, and a lower end secured to said second end section; and said second part comprises:

at least one longitudinal channel shorter than, and engaging said guide member;

whereby the second part is slidingly held by said channel and guide member against the inner face of said plate; and wherein said means for slidingly connecting comprise means for resiliently biasing said second part away from said first part.

2. The device of claim 1, wherein said means for resiliently biasing comprises a longitudinally stretchable, elastomeric strap having a first extremity permanently attached to said second end section, and an opposite extremity attached to said second part.

3. The device of claim 2, wherein said second part comprises:

a lower portion having a slot shaped and dimensioned to slidingly engage said elastomeric strap;

an upper portion; and means for adjustably attaching said opposite extremity to said upper portion.

4. The device of claim 3, wherein said means for adjustably attaching comprises:

a first patch of fabric fastener bonded to said opposite extremity; and a second patch of fabric fastener interconnectable with said first patch and bonded to said upper portion.

5. A device for protecting first and second elongated members and their articulated joint which comprises:

a first part shaped and dimensioned to intimately cradle a portion of said first member;

a second part shaped and dimensioned to intimately cradle a portion of the said second member;

an oblong plate having an inner face, an outer face, first and second opposite longitudinal end sections, and first and second opposite lateral edges;

means for hingedly connecting said first end section to said first part about a transversal axis; and means for axially and slidingly connecting said inner face to said second part;

wherein said plate further comprises:

at least one elongated guide member having a given length, an upper end secured to said first end section, and a lower end secured to said second end section; and said second part comprises:

at least one longitudinal channel shorter than, and engaging said guide member;

whereby the second part is slidingly held by said channel and guide member against the inner face of said plate; and wherein said first part comprises at least one strap shaped, positioned and dimensioned to secure said first part to said first member; and wherein said second part comprises at least one strap shaped, positioned and dimensioned to secure said second part to said second member.

6. The device of claim 5, wherein said first part is shaped and dimensioned to cradle a human above-the-knee leg portion; and said second part is shaped and dimensioned to cradle a human below-the-knee leg portion.

7. The device of claim 6, wherein said guide member comprises a strip of semi-rigid synthetic material; and said channel comprises a patch of fabric secured along opposite lateral edges to said second part.

8. The device of claim 5, wherein said first part further comprises a resiliently compressible pad lining an inner portion of said first part.

9. The device of claim 5, wherein:

said plate comprises first and second ones of said at least one elongated guide member each located along one of said lateral edges; and the second part comprises first and second ones of said at least one longitudinal channel shorter than and engaging said guide members.

10. The device of claim 5, wherein said second part comprises a shin plate; and a connecting plate hingedly attached at a first end section to said first part, and slidingly attached at a second end section to said shin plate.

11. The device of claim 10, wherein said second part further comprises a resiliently stretchable strap between said shin plate and connecting plate, said strap being positioned to bias said first part away from said shin plate.

12. The device of claim 11, wherein said shin plate comprises a plurality of anchor points for said strap;

whereby the tension of said strap may be adjusted by selection of one of said anchor points.

* * * * *